United States Patent [19]

Masci

[11] Patent Number: 4,718,174

[45] Date of Patent: Jan. 12, 1988

[54] TEMPLATE FOR CUTTING AND FOLDING FURS

[75] Inventor: Roberto Masci, Rome, Italy

[73] Assignee: Paola Fendi & S.lle S.A.S., Rome, Italy

[21] Appl. No.: 910,712

[22] Filed: Sep. 24, 1986

[30] Foreign Application Priority Data

Apr. 27, 1986 [IT] Italy ..... 48066 A/86
May 27, 1986 [IT] Italy ..... 35850/86[U]

[51] Int. Cl.[4] ..... A41H 1/00; A42C 3/00

[52] U.S. Cl. ..... 33/562; 2/65; 112/401; 33/2 R; 33/11

[58] Field of Search ..... 33/2, 11, 17, 562, 563; 83/915; 112/401; 2/65; 69/22, 33

[56] References Cited

U.S. PATENT DOCUMENTS 931,235 8/1909 Theoerkauf ..... 2/65 X
1,331,527 2/1920 Rinfret ..... 2/65 X
1,724,192 8/1929 Greenberg et al. ..... 112/401
2,482,929 9/1949 Nierenberg ..... 112/401

FOREIGN PATENT DOCUMENTS 3014594 11/1981 Fed. Rep. of Germany ..... 69/22

*Primary Examiner*—Harry N. Haroian
*Attorney, Agent, or Firm*—Beveridge, DeGrandi & Weilacher

[57] ABSTRACT

A template for cutting and folding furs is disclosed. The template is symmetrical with respect to the longitudinal seam of the skins or furs. The template has a removable central portion defined laterally by two segments or sides that are parallel to each other and parallel to the longitudinal seam between the skins, and transversely by segments or sides, one of which faces the tail of the skin which is aligned with the longitudinal axis of the template, along a cutting line having a curvature. The barycentre of the removable central portion is almost aligned with the transverse seam lines of the skins.

5 Claims, 2 Drawing Figures

TEMPLATE FOR CUTTING AND FOLDING FURS

BACKGROUND OF THE INVENTION

The present invention relates to a template for cutting and folding furs.

More particularly, the present invention relates to a template for cutting and folding furs, which is suitable for use in the manufacture of skins in industry and by the craftsman for making fur coats.

As is well known, in order to produce a fur coat, pelts or skins are commonly joined both in the longitudinal and in the transverse directions by sewing an end, hereinafter referred to as the tail of one skin with an opposite end or the head of the next skin or pelt.

In so joining or sewing together the skins it is necessary to make a careful selection of skins so that, once they have been sewn, they will result in a chromatically uniform garment with uniform fur length, and density or thickness.

Different systems are known at present for providing the transversal seam, which systems are based providing a vertical junction or seam between the head part of one skin and the tail part of another. This junction can unconcealed or it can be covered with a flounce which extends along the entire length of the transverse seam. The main drawbacks of such joining or stitching systems arises from the fact that the aesthetic quality of the final product depends upon the work of highly specialized personnel or handicraftsmen who, in order to achieve the required color material uniformity, are compelled to reject substantial amounts of fur material or otherwise to use large amounts of the material which of course results in substantial cost increases in the final product.

SUMMARY OF THE INVENTION

According, it is an object of the present invention to provide a template for cutting and folding skins for forming the horizontal seam of the skins. The horizontal seam forming operation with use of the template of the present invention overcomes the disadvantages of the joining techniques discussed above.

Thus, it is a specific object of the present invention to provide a cutting and folding template for manufacturing fur coats. The template is symmetrical with respect to the longitudinal seam between the skins. The template has a removable central part which is delimited laterally by two sides or segments which are parallel to each other and to the longitudinal seam between the skins. The central part is further defined by the sides or segments, one of which faces the tail part of a skin which is aligned with the longitudinal axis of the template, along a cutting line having a curvature. The barycentre of the removable central part is almost aligned with the transverse seam lines of the skins.

According to an alternative preferred embodiment of the template of the present invention, the transversal segments, delimiting the central zone or portion to be removed, are made up of two broken lines which slope, in a symmetrical way, with respect to the longitudinal axis.

BRIEF DESCRIPTION OF THE DRAWINGS

The preferred embodiments of the present invention will be described in the following detailed description for illustrative but not limitative purposes with to the enclosed drawings wherein like parts bear like reference numerals. In the drawings.

DETAILED DESCRIPTION OF THE PREFERRED EMBODIMENTS

Figure 1:
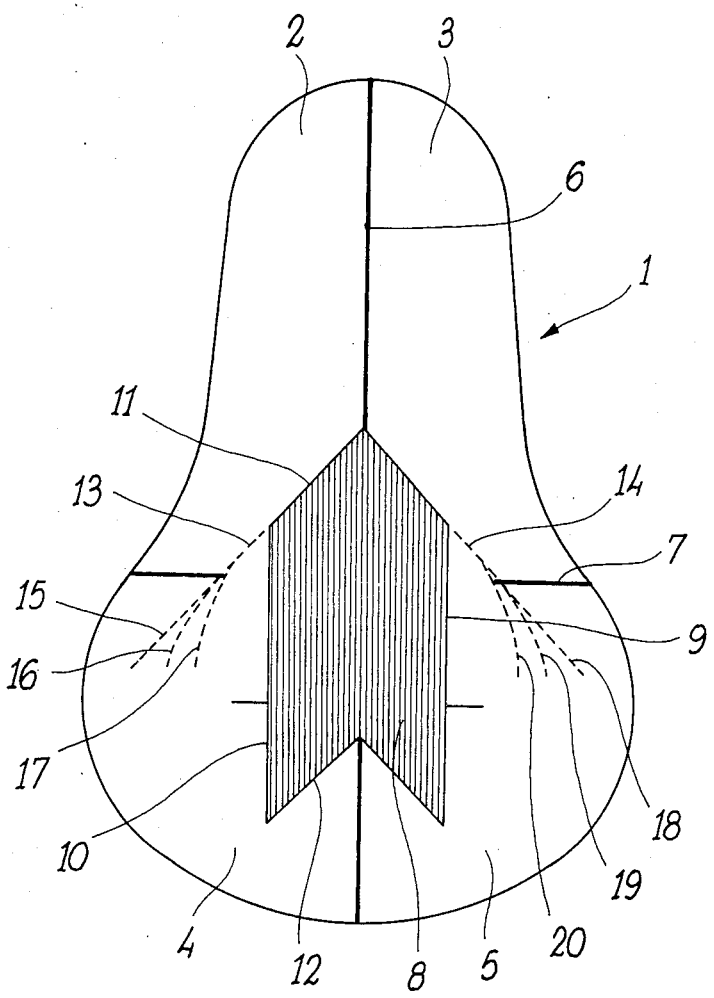
FIG. 1 is a front, elevational view of a preferred cutting and folding template according to the present invention.

FIG. 1 shows a template 1 for providing transverse seams for the skins.

The zones 2, 3, 4 and 5 into which the template of FIG. 1 is divided corresponding to the skins to be joined longitudinally along a line identified by reference numeral 6 and transversely along another line identified by reference numeral 7.

The central part 8 of the template corresponds to a portion of the fur to be removed to carry out the joining or seaming operation with the desired folding.

The central part 8 in the embodiment of FIG. 1 is defined by two longitudinal sides or segments 9 and 10 which are parallel to the axis of the longitudinal seam and by two sides or segments 11 and 12 formed to appear as a broken or nonstraight line which sides or segments are provided the zones 2, 3, 4 and 5 of the template.

The slopes of segments or sides 11 and 12 with respect to the vertical axis 6 can be varied.

The cutting lines representing the projections of the segment 11 (which lines are shown in FIG. 1 as dotted lines) have a first length 13 and 14 which branches successively into the three lines 15, 16, 17 and 18, 19, 20.

The choice of the cutting line 15 or 16 or 17 and, respectively, of the line 18, 19 or 20 depends upon the width of the skin to provide the greatest strength for the central part of the seam.

Figure 2:
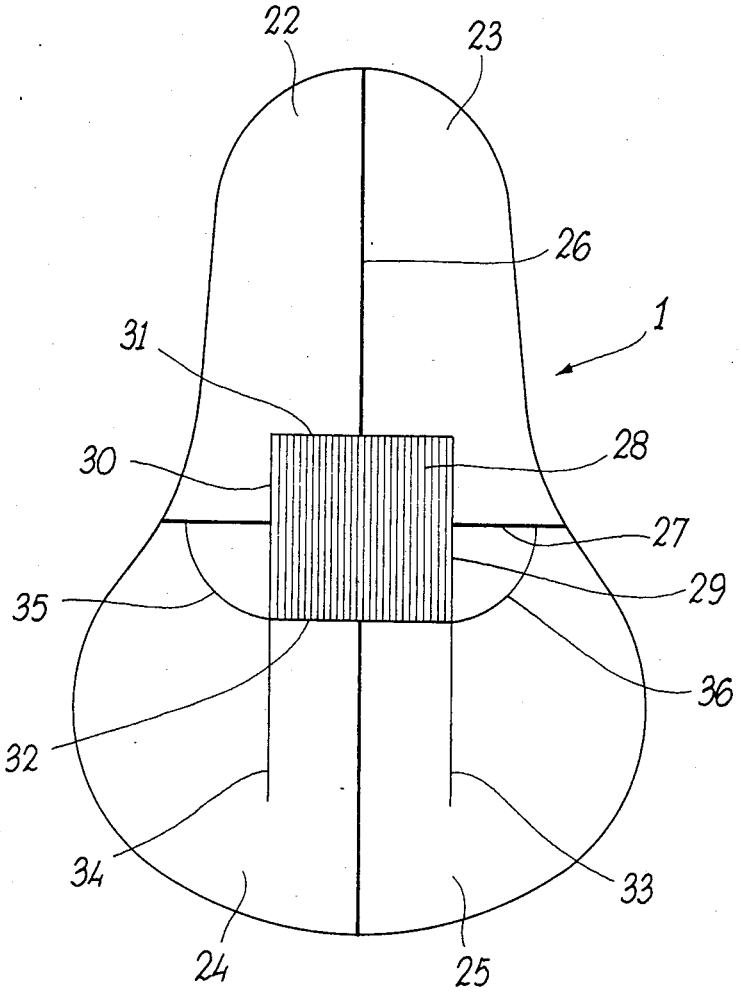
FIG. 2 is a view similar to FIG. 1 of an alternative embodiment of a cutting and folding template according to the present invention.

FIG. 2 shows another embodiment of a template 1' according to the invention. In a similar way, template 1' is divided into four zones 22, 23, 24 and 25 corresponding to four skins to be joined longitudinally along line 26 and transverely along line 27. In the central part of the template 1' a quadrangular zone 28 is shown. Zone 28 is to a generally rectangular removable portion having two longitudinal sides or segments 29 and 30 and by two transverse sides or segments 31 and 32.

Extensions of segments 29 and 30 make up the resting or supporting lines 33 and 34 respectively in the zones 25 and 24 corresponding to the head part of the skins to be joined.

Cutting lines 35 and 36, which curve towards the tail part, begin at the apices of the quadrangular zone 28 which which correspond to the head part of the skin. The curvature of lines 35 and 36 can also be varied depending upon the sizes of the skins to be joined together.

The present invention has been disclosed according to preferred embodiments, but it is to be understood that modifications and changes can be made by those skilled in the art without departing from the spirit and scope of the invention.

I claim:

1. A template for use in cutting and folding skins for fur garments including a plurality of skins and transverse and longitudinal seams between the skins, said template having:

two symmetrical portions defining a longitudinal axis therebetween, a removable portion located centrally of said template, said portion being removable to form an opening defined by two parallel sides and an upper and a lower end through said template, said sides being parallel to said longitudinal axis; and curving means on said template for indicating cutting locations on the skins.

2. A template as claimed in claim 1, wherein said upper and lower ends are shaped as broken lines whereby said removable portion is arrow-shaped.

3. A template as claimed in claim 2, wherein said removable portion is removed to form said opening.

4. A template as claimed in claim 1, wherein said upper and lower ends are parallel with the transverse seams and said curving means curves upwardly from the lower corners of said removable portion.

5. A template as claimed in claim 4, wherein said removable portion is removed to form said opening.

* * * * *